US006713696B1

(12) United States Patent
Skarlupka et al.

(10) Patent No.: US 6,713,696 B1
(45) Date of Patent: Mar. 30, 2004

(54) ONE PIECE TOGGLE SWITCH COVER WITH INTEGRAL PANEL STANDOFF AND SEAL RECEPTACLE

(75) Inventors: Michael J. Skarlupka, Freeport, IL (US); Brad L. Cummins, Freeport, IL (US); Nathan W. Johnson, Winslow, IL (US); David S. Evans, Lena, IL (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/326,507

(22) Filed: Dec. 20, 2002

(51) Int. Cl.[7] ..... H01H 9/02
(52) U.S. Cl. ..... 200/302.3; 200/339
(58) Field of Search ..... 200/553, 302.1, 200/302.3, 335, 339, 296

(56) References Cited

U.S. PATENT DOCUMENTS 2,650,964 A * 9/1953 Razdow ..... 200/457
3,047,682 A * 7/1962 Hults ..... 200/16 A
3,311,718 A * 3/1967 Allison et al. ..... 200/11 K
4,191,387 A * 3/1980 Kirchoff ..... 277/507
4,370,528 A * 1/1983 Aschenbach ..... 200/6 BB
4,758,724 A * 7/1988 Osika ..... 200/315
5,719,434 A * 2/1998 Levine et al. ..... 257/666

* cited by examiner

*Primary Examiner*—Michael A. Friedhofer
(74) *Attorney, Agent, or Firm*—Kris T. Fredrick

(57) ABSTRACT

A toggle switch includes a one piece integrated plate, stand off, and bushing. The stand off has protrusions extending therefrom, and the stand off and the protrusions form a seal receptacle and determine a stand off depth of the plate from a panel. An O-ring seal is seated around the bushing and within the seal receptacle. The toggle lever extends through an opening of the bushing. The bushing and the toggle level are inserted through a hole in the panel until the protrusions engage the panel. The switch cover is fastened to the panel using a single fastener so that the O-ring seal is squeezed between the stand off and the panel to provide a seal between the panel and the switch cover.

49 Claims, 2 Drawing Sheets

ONE PIECE TOGGLE SWITCH COVER WITH INTEGRAL PANEL STANDOFF AND SEAL RECEPTACLE

TECHNICAL FIELD OF THE INVENTION

The present invention relates to a one piece toggle switch cover having an integral panel standoff and seal receptacle.

BACKGROUND OF THE INVENTION

A typical toggle switch has a toggle lever that is pivoted about a pin in order to control the position of one or more switch contacts. The pin passes through a bushing and the toggle lever so as to support the toggle lever for pivotal movement. Toggle switches are used in a variety of applications that frequently require the mounting of the toggle switches to panels such that the toggle levers of the toggle switches protrude from a first side of the panels and extend through the panels to operate switches on an opposing second side of the panels. A seal is usually provided between the toggle lever and the switch in order to prevent moisture and other contaminants from passing around the toggle lever and into the switch.

The current method of mounting a toggle switch to a panel relies on the use of a threaded bushing of the toggle switch. A first nut is threaded onto the threaded bushing to a predetermined depth. The first nut is used as a panel stop. That is, the toggle switch is inserted through a corresponding hole through the panel until the first nut engages the second side of the panel, at which point the first nut prevents further movement of the toggle switch through the hole. At this point, the toggle switch stands off of the panel by the predetermined depth established by the first nut. A second nut is then threaded onto the bushing and tightened until it engages the first side of the panel. Accordingly, the second nut secures the toggle switch to the panel.

This mounting arrangement has a number of problems. For example, the use of two nuts, one for the stand off depth and one for securing the toggle switch to the panel, is labor intensive. Also, the use of these two nuts results in inconsistent stand off depths between toggle switches when multiple toggle switches are mounted to the same panel because the same stand off depth from toggle switch to toggle switch is difficult to maintain. Further, it is difficult and expensive to seal the panel around the toggle switch because of the presence of a key slot and threads typically used in the cover bushing. A specially manufactured sealing nut is usually required to provide this sealing and, optionally, a specially manufactured sealing washer is provided to seal the keyway.

The present invention is directed to a toggle switch that overcomes one or more of these or other problems.

SUMMARY OF THE INVENTION

In accordance with one aspect of the present invention, a toggle switch comprises a one piece integral switch cover, an O-ring seal, and a toggle lever. The one piece integral switch cover has a plate, a stand off, and a bushing. The seal seats around the bushing. The toggle lever extends through an opening of the bushing.

In accordance with another aspect of the present invention, a toggle switch comprises a panel, a one piece integral switch cover, an O-ring seal, and a toggle lever. The panel has a hole therethrough and has first and second opposing sides. The one piece integral switch cover has a plate, a stand off, and a bushing. The stand off has protrusions extending therefrom, the stand off engages the panel, and the stand off determines a stand off depth of the plate from the panel. The bushing extends through the hole so that the bushing is on the first side of the panel and the plate and stand off are on the second side of the panel. The seal is seated around the bushing, and the seal is squeezed between the panel and the stand off. The toggle lever extends through an opening of the bushing.

In accordance with still another aspect of the present invention, a method is provided to fasten a toggle switch to a panel. The toggle switch comprises a plate, a stand off, a seal, a bushing, and a toggle lever. The stand off has protrusions extending therefrom, and the stand off and the protrusions determine a stand off depth of the plate from the panel. The seal is seated around the bushing and within the protrusions so that the protrusions determine an amount of compression of the seal. The toggle lever extends through an opening of the bushing. The method comprises the following: inserting the bushing and the toggle level through a hole in the panel until the protrusions engage the panel; and, fastening the toggle switch to the panel by use of a single fastener so that the seal is squeezed between the stand off and the panel to provide a seal between the panel and the toggle switch.

In accordance with yet another aspect of the present invention, a toggle switch comprises a switch cover and a toggle lever. The switch cover has a plate and a bushing, and the bushing has a threaded area in proximity to the plate and an unthreaded area away from the plate. The toggle lever extends through an opening of the bushing.

BRIEF DESCRIPTION OF THE DRAWINGS

These and other features and advantages will become more apparent from a detailed consideration of the invention when taken in conjunction with the drawings in which.

DETAILED DESCRIPTION

Figure 2:
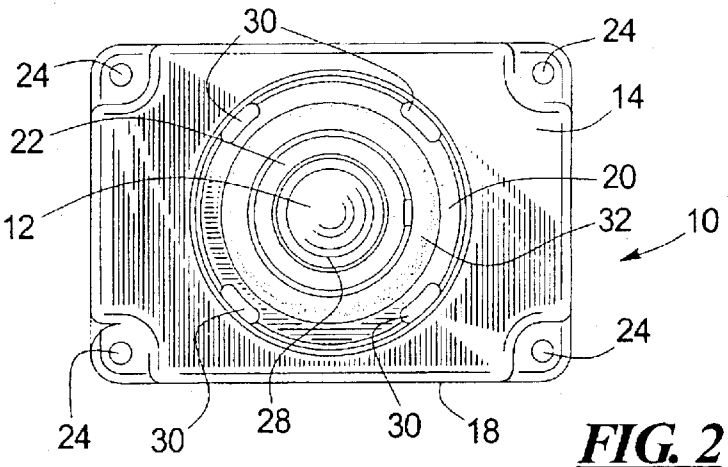
FIG. 2 is a top view of the toggle switch shown in FIG. 1.
Figure 3:
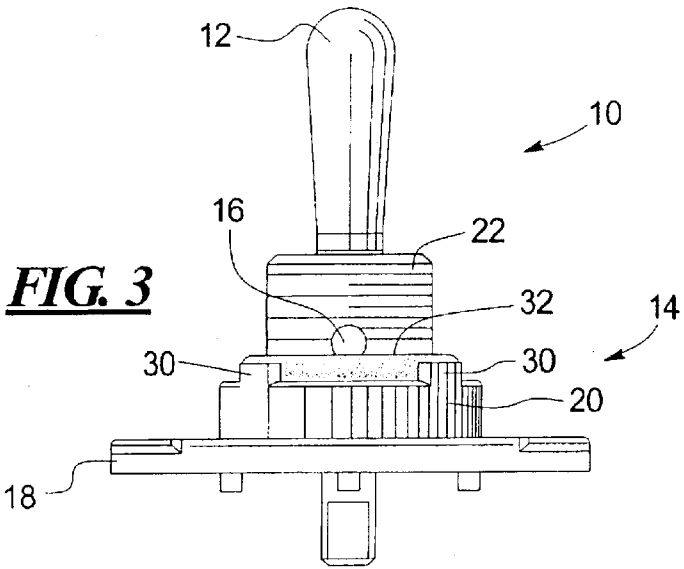
FIG. 3 is a side view of the toggle switch of FIG. 1.
Figure 1:
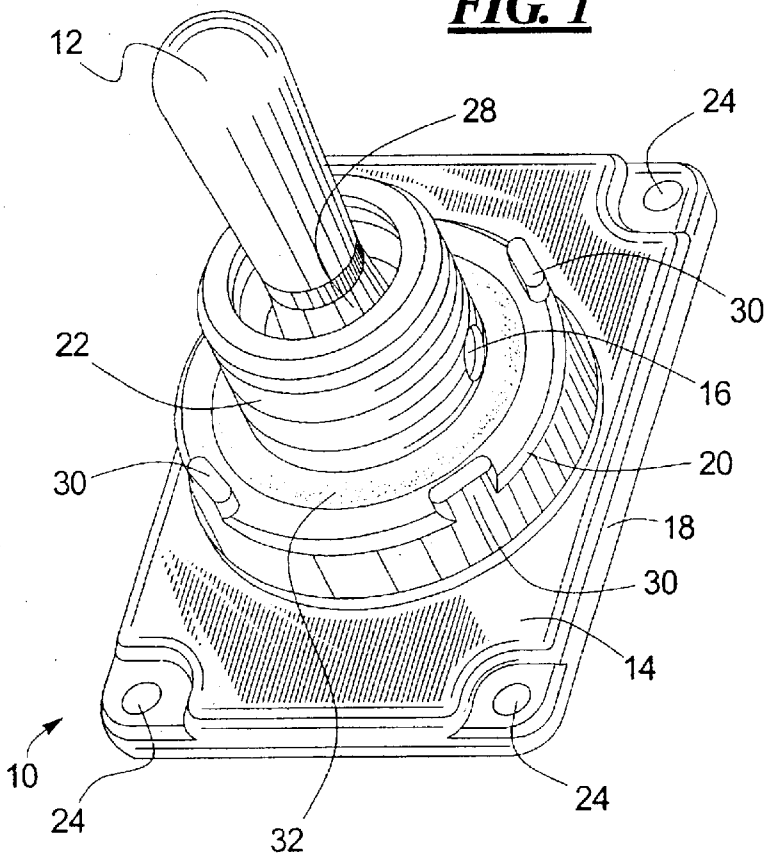
FIG. 1 is an isometric view of a toggle switch according to one embodiment of the present invention.

A toggle switch 10 according to one embodiment of the present invention is shown in FIGS. 1–3. The toggle switch 10 includes a toggle lever 12 and a switch cover 14 that are joined together by a pin 16 suitably pressed in or otherwise fastened to the switch cover 14.

The switch cover 14 of the toggle switch 10 is a one piece integral switch cover having a plate 18, a stand off 20, and a bushing 22. Because the switch cover 14 is a one piece integral switch cover, the material forming the switch cover 14 is continuous having no breaks as would be expected if the switch cover 14 were made up of separate parts fastened or bonded together. Accordingly, the material of the switch cover 14 continuously forms the plate 18, the stand off 20, and the bushing 22. For example, the switch cover 14 may be extruded or cast.

The plate 18 has holes 24 for receiving rivets, screws, or other fasteners to fasten the switch cover 14 to a switch case 26 (FIG. 4) that contains at least one movable switch contact operated by the toggle lever 12. A seal 28 is provided between the toggle lever 12 and the bushing 22 of the switch cover 14 in order to prevent moisture and other contaminants from passing through the toggle switch 10 between the toggle lever 12 and the bushing 22.

The stand off 20 has protrusions 30 that have a dimension perpendicular to the plate 18 for determining the stand off depth, i.e., the distance that the plate 18 and the switch case 26 fastened thereto stand off from the panel to which the toggle switch 10 is fastened. The protrusions 30 are also continuously formed from the material that is used to form the switch cover 14.

The protrusions 30 form a receptacle for holding an O-ring seal 32. The stand off 20 and the protrusions 30 form a seal receptacle that receives and helps to position the O-ring seal 32 when the switch mounting nut (discussed below) is tightened to the point where the protrusions 30 bottom out against the bottom of the panel. The protrusions 30 also prevent the O-ring seal 32 from being overly squeezed as a switch mounting nut 34 is tightened. Moreover, the protrusions 30 further result in a higher force being transmitted to the panel so as to prevent the toggle switch 10 from spinning.

The bushing 22 and the toggle lever 12 have corresponding pin receiving holes to receive the pin 16. The pin 16 accordingly provides a pivot about which the toggle lever 12 is toggled. The bushing 22 is also provided with threads to receive the switch mounting nut 34 so as to fasten the toggle switch 10 to a panel 36.

Figure 4:
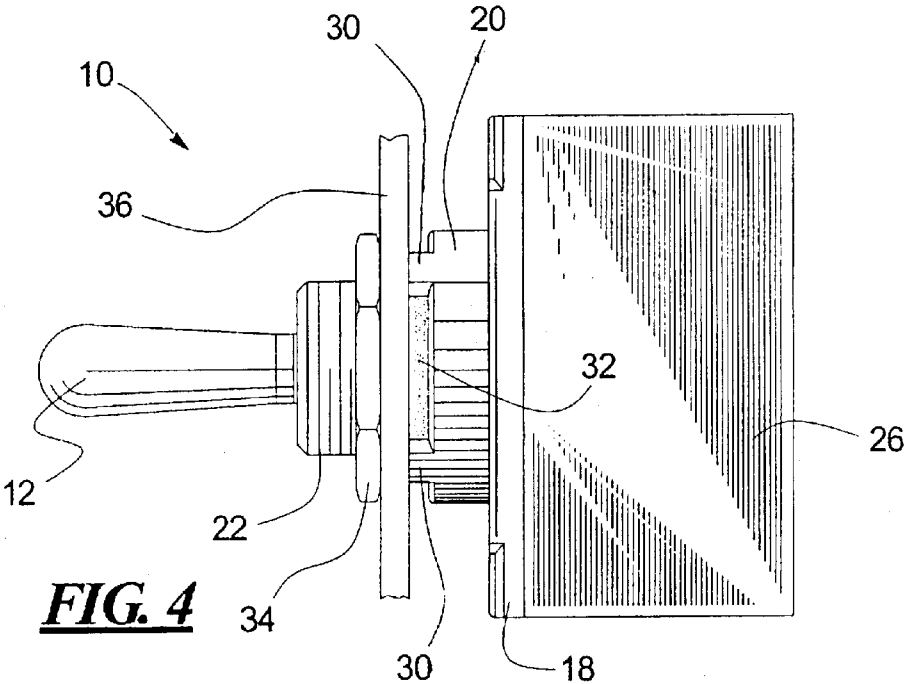
FIG. 4 illustrates the toggle switch of FIGS. 1–3 mounted to a panel; and, FIGS. 5–7 illustrate an easy start thread feature according to an embodiment of the invention.

During mounting of the toggle switch 10 to the panel 36 as shown in FIG. 4, the toggle switch 10 is inserted through a hole in the panel 36, and the switch mounting nut 34 is threaded onto the bushing 22 and tightened until the protrusions 30 bottom out on the panel 36. The O-ring seal 32 is accordingly squeezed between the panel 36 and the stand off 20 in order to thereby provide a tight seal between the panel 36 and the toggle switch 10.

As compared to prior art panel mounted toggle switches, the toggle switch 10 allows for faster and more consistent switch installation. The protrusions 30 and the stand off 20 with the O-ring seal 32 provide a flat sealing surface as well as a panel stop. Accordingly, only a single nut, i.e., the switch mounting nut 34, is required to fasten the toggle switch 10 to the panel 36 at the proper depth. In addition, a locking washer on the same side of the panel as the switch mounting nut 34 may be provided to prevent the switch mounting nut 34 from loosening under vibration or other conditions. In this case, the switch mounting nut 34 and the locking washer are considered to be a single fastener.

Figure 5:
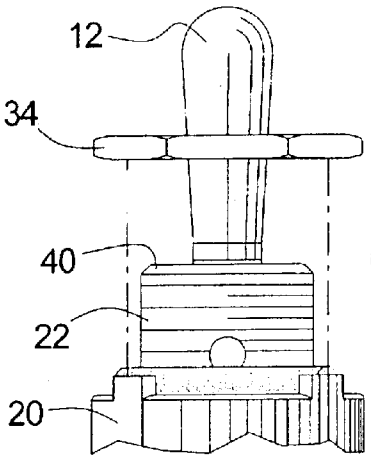
Figure 6:
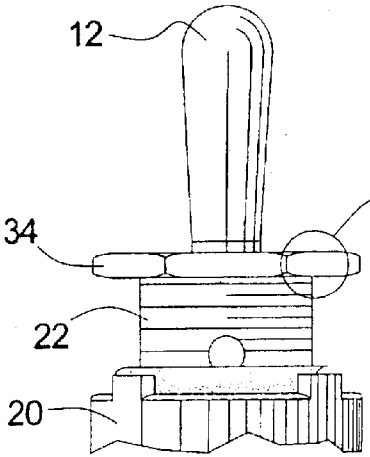
Figure 7:
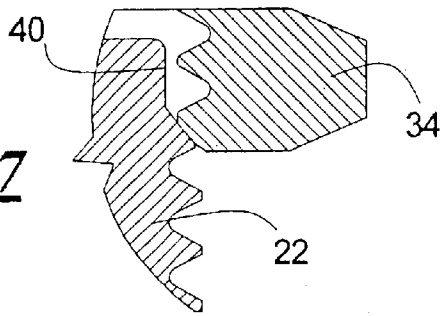

As shown in FIGS. 5–7, the bushing 22 is threaded except at an unthreaded area 40 that is uppermost on the bushing 22. The unthreaded area 40 of the bushing 22 has a maximum outside diameter that is less than the corresponding minimum minor diameter of the threads on the switch mounting nut 34. Accordingly, the unthreaded area 40 of the bushing 22 allows the switch mounting nut 34 to be easily positioned on the bushing 22 in a plane located perpendicularly to the axis of bushing 22 prior to actually threading the switch mounting nut 34 onto the bushing 22. The unthreaded area 40 provides easy alignment of the switch mounting nut 34, and significantly reduces the possibility for cross threading of the switch mounting nut 34 onto the bushing 22. Once the switch mounting nut 34 is positioned in this location as dictated by the unthreaded area 40, simply rotating the switch mounting nut 34 will successfully engage the threads of the switch mounting nut 34 with the corresponding mating threads of the bushing 22. This feature not only contributes to easier hand mounting of the toggle switch 10, but also is especially beneficial when using power equipment to fasten the switch mounting nut 34 to the bushing 22 because improper alignment that might otherwise result can rapidly cause cross threading, thus rendering the toggle switch 10 useless. The length of the unthreaded area 40 along the bushing 22 may be selected based upon the height of the switch mounting nut 34 but should be sufficient to permit this easy threading feature.

Modifications and/or alternatives of the present invention will occur to those practicing in the art of the present invention. For example, as described above, the toggle switch 10 is fastened to the panel 36 by way of the switch mounting nut 34. However, other fastening devices, such as c-springs, can be used to fasten the toggle switch 10 to the panel 36.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. A toggle switch comprising:

a one piece integral switch cover having a plate, a stand off, and a bushing;

a seal for seating around the bushing; and, a toggle lever extending through an opening of the bushing.

2. The toggle switch of claim 1 wherein the bushing is arranged to receive a fastener.

3. The toggle switch of claim 2 wherein the bushing comprises a threaded bushing, and wherein the fastener comprises a switch mounting nut for threading over the threaded bushing.

4. The toggle switch of claim 1 wherein the seal comprises a first seal, and wherein the toggle switch further comprises a second seal between the toggle lever and the bushing.

5. The toggle switch of claim 4 wherein the bushing is arranged to receive a fastener.

6. The toggle switch of claim 5 wherein the bushing comprises a threaded bushing, and wherein the fastener comprises a switch mounting nut for threading over the threaded bushing.

7. The toggle switch of claim 1 further comprising a cup shaped switch case fastened to the plate.

8. The toggle switch of claim 7 wherein the bushing is arranged to receive a fastener.

9. The toggle switch of claim 8 wherein the bushing comprises a threaded bushing, and wherein the fastener comprises a switch mounting nut for threading over the threaded bushing.

10. The toggle switch of claim 7 wherein the seal comprises a first seal, and wherein the toggle switch further comprises a second seal between the toggle lever and the bushing.

11. The toggle switch of claim 10 wherein the bushing is arranged to receive a fastener.

12. The toggle switch of claim 11 wherein the bushing comprises a threaded bushing, and wherein the fastener comprises a switch mounting nut for threading over the threaded bushing.

13. The toggle switch of claim 1 wherein the stand off comprises protrusions extending therefrom, and wherein the protrusions are arranged to prevent over compression of the seal.

14. The toggle switch of claim 13 wherein the seal comprises an O-ring seal.

15. A toggle switch comprising:

a panel having a hole therethrough and having first and second opposing sides;

a one piece integral switch cover having a plate, a stand off, and a bushing, wherein the stand off has protrusions extending therefrom, wherein the stand off engages the panel, wherein the stand off determines a stand off depth of the plate from the panel, and wherein the bushing extends through the hole so that the bushing is on the first side of the panel and so that the plate and the stand off are on the second side of the panel;

a seal seated around the bushing, wherein the seal is squeezed between the panel and the stand off; and, a toggle lever extending through an opening of the bushing.

16. The toggle switch of claim 15 wherein the stand off comprises protrusions extending therefrom, wherein the protrusions determined a level of compression on the seal.

17. The toggle switch of claim 16 further comprising a fastener received by the bushing to fasten the switch cover to the panel.

18. The toggle switch of claim 17 wherein the bushing comprises a threaded bushing, and wherein the fastener comprises a switch mounting nut threaded over the threaded bushing.

19. The toggle switch of claim 16 wherein the seal comprises a first seal, and wherein the toggle switch further comprises a second seal between the toggle lever and the bushing.

20. The toggle switch of claim 19 further comprising a fastener received by the bushing to fasten the switch cover to the panel.

21. The toggle switch of claim 20 wherein the bushing comprises a threaded bushing, and wherein the fastener comprises a switch mounting nut threaded over the threaded bushing.

22. The toggle switch of claim 16 further comprising a cup shaped switch case fastened to the plate.

23. The toggle switch of claim 22 further comprising a fastener received by the bushing to fasten the switch cover to the panel.

24. The toggle switch of claim 23 wherein the bushing comprises a threaded bushing, and wherein the fastener comprises a switch mounting nut threaded over the threaded bushing.

25. The toggle switch of claim 22 wherein the seal comprises a first seal, and wherein the toggle switch further comprises a second seal between the toggle lever and the bushing.

26. The toggle switch of claim 25 further comprising a fastener received by the bushing to fasten the switch cover to the panel.

27. The toggle switch of claim 26 wherein the bushing comprises a threaded bushing, and wherein the fastener comprises a switch mounting nut threaded over the threaded bushing.

28. The toggle switch of claim 15 wherein the seal comprises an O-ring seal.

29. A method of fastening a toggle switch to a panel, wherein the toggle switch comprises a plate, a stand off, a seal, a bushing, and a toggle lever, wherein the stand off has a plurality of protrusions extending therefrom, wherein the stand off and the protrusions determine a stand off depth of the plate from the panel, wherein the seal is seated around the bushing, against the stand off, and within the protrusions so that the protrusions determine an amount of compression of the seal, wherein the toggle lever extends through an opening of the bushing, and wherein the method comprises:

inserting the bushing and the toggle level through a hole in the panel until the protrusions engage the panel;

fastening the toggle switch to the panel by use of a single fastener so that the seal is squeezed between the stand off and the panel to provide a seal between the panel and the toggle switch.

30. The method of claim 29 wherein the fastening of the toggle switch to the panel comprises applying the single fastener to the bushing.

31. The method of claim 30 wherein the applying of the single fastener to the bushing comprises threading a single switch mounting nut onto the bushing.

32. The method of claim 29 wherein the seal comprises a first seal, and wherein the toggle switch further comprises a second seal between the toggle lever and the bushing.

33. The method of claim 32 wherein the fastening of the toggle switch to the panel comprises applying the single fastener to the bushing.

34. The method of claim 33 wherein the applying of the single fastener to the bushing comprises threading a single switch mounting nut onto the bushing.

35. The method of claim 29 wherein the toggle switch further comprises a cup shaped switch case fastened to the plate.

36. The method of claim 35 wherein the fastening of the toggle switch to the panel comprises applying the single fastener to the bushing.

37. The method of claim 36 wherein the applying of the single fastener to the bushing comprises threading a single switch mounting nut onto the bushing.

38. The method of claim 35 wherein the seal comprises a first seal, and wherein the toggle switch further comprises a second seal between the toggle lever and the bushing.

39. The method of claim 38 wherein the fastening of the toggle switch to the panel comprises applying the single fastener to the bushing.

40. The method of claim 39 wherein the applying of the single fastener to the bushing comprises threading a single switch mounting nut onto the bushing.

41. The method of claim 29 wherein the plate, the stand off, and the bushing comprise a one piece integral switch cover.

42. A toggle switch comprising:

a switch cover having a plate and a bushing, wherein the bushing has a threaded area in proximity to the plate and an unthreaded area away from the plate, wherein the unthreaded area is sized in relation to the threaded area so as to facilitate threading of a switch mounting nut onto the threaded area of the bushing and to thereby reduce the possibility of cross threading of the switch mounting nut onto the bushing; and, a toggle lever extending through an opening of the bushing.

43. The toggle switch of claim 42 wherein the unthreaded area has a maximum outside diameter that is less than a corresponding minimum minor diameter of threads on a switch mounting nut that engages the bushing.

44. The toggle switch of claim 42 further comprising a switch mounting nut threadably engaging the threaded area of the bushing, wherein the unthreaded area has a maximum outside diameter that is less than a corresponding minimum minor diameter of threads on the switch mounting nut.

45. The toggle switch of claim 42 further comprising a seal around the bushing.

46. The toggle switch of claim 45 further comprising protrusions extending from the plate, wherein the protrusions are arranged to prevent over compression of the seal.

47. The toggle switch of claim 46 wherein the seal comprises an O-ring seal.

48. The toggle switch of claim 45 wherein the seal comprises a first seal, and wherein the toggle switch further comprises a second seal between the toggle lever and the bushing.

49. The toggle switch of claim 42 further comprising a switch case fastened to the plate.

* * * * *